United States Patent [19]

Chang

[11] Patent Number: 4,709,735

[45] Date of Patent: Dec. 1, 1987

[54] AUTOMATIC SHUT-OFF DEVICE FOR FUEL DISPENSER

[76] Inventor: King-chang Chang, No. 20, Hsi Wei Street, San Chung City, Taiwan

[21] Appl. No.: 688,525

[22] Filed: Jan. 3, 1985

[51] Int. Cl.[4] ..... B67D 5/04

[52] U.S. Cl. ..... 141/209

[58] Field of Search ..... 141/209, 210; 222/16

[56] References Cited

U.S. PATENT DOCUMENTS

| | | | |
|---|---|---|---|
| 3,072,294 | 1/1963 | Myers | 141/209 X |
| 3,327,740 | 6/1967 | Murray | 141/209 |
| 3,341,075 | 9/1967 | Boudot et al. | 141/209 X |
| 3,370,623 | 2/1968 | Murray | 141/209 X |
| 3,811,486 | 5/1974 | Wood | 141/209 |
| 4,453,578 | 6/1984 | Wilder | 141/209 |

*Primary Examiner*—Stephen Marcus
*Assistant Examiner*—Mark Thronson
*Attorney, Agent, or Firm*—Asian Pacific International Patent and Trademark Office

[57] ABSTRACT

An automatic shut-off device for a fuel dispenser giving a set quantity of fuel into a tank or the like. The device can release a handle member by means of the returning force of a spring so as to shut off a valve in the fuel pipe.

4 Claims, 3 Drawing Figures

AUTOMATIC SHUT-OFF DEVICE FOR FUEL DISPENSER

BACKGROUND OF THE INVENTION

Petroleum or gasoline is rather flammable, and any negligence in handling it represents a fire hazard. Today, it is the tendency to operate a gas station automatically and by computer, and any possible problem concerning a safe operation must be considered because of the operator being not quite familiar with the dispenser. Particularly, after a given quantity of fuel has been filled into a tank, the flowing fuel has to be shut off definitely.

In view of the aforesaid facts, the inventor has, through repeated studies, developed a device in a dispenser that can automatically shut off the flowing fuel and can also sense the fuel level in a tank being filled. The device provides greater safety and higher convenience during operation.

SUMMARY OF THE INVENTION

This invention provides an automatic shut-off device, particularly an automatic device for a fuel dispenser. The feature of the dispenser is that a trigger means is mounted on the handle guard of the dispenser; and the trigger means is operatively coupled with a sensing means that can detect whether or not fuel is flowing. As soon as a given quantity of fuel is filled into a tank, the dispenser of the present invention will automatically turn to a shut-off position.

DETAILED DESCRIPTION

Figure 1:
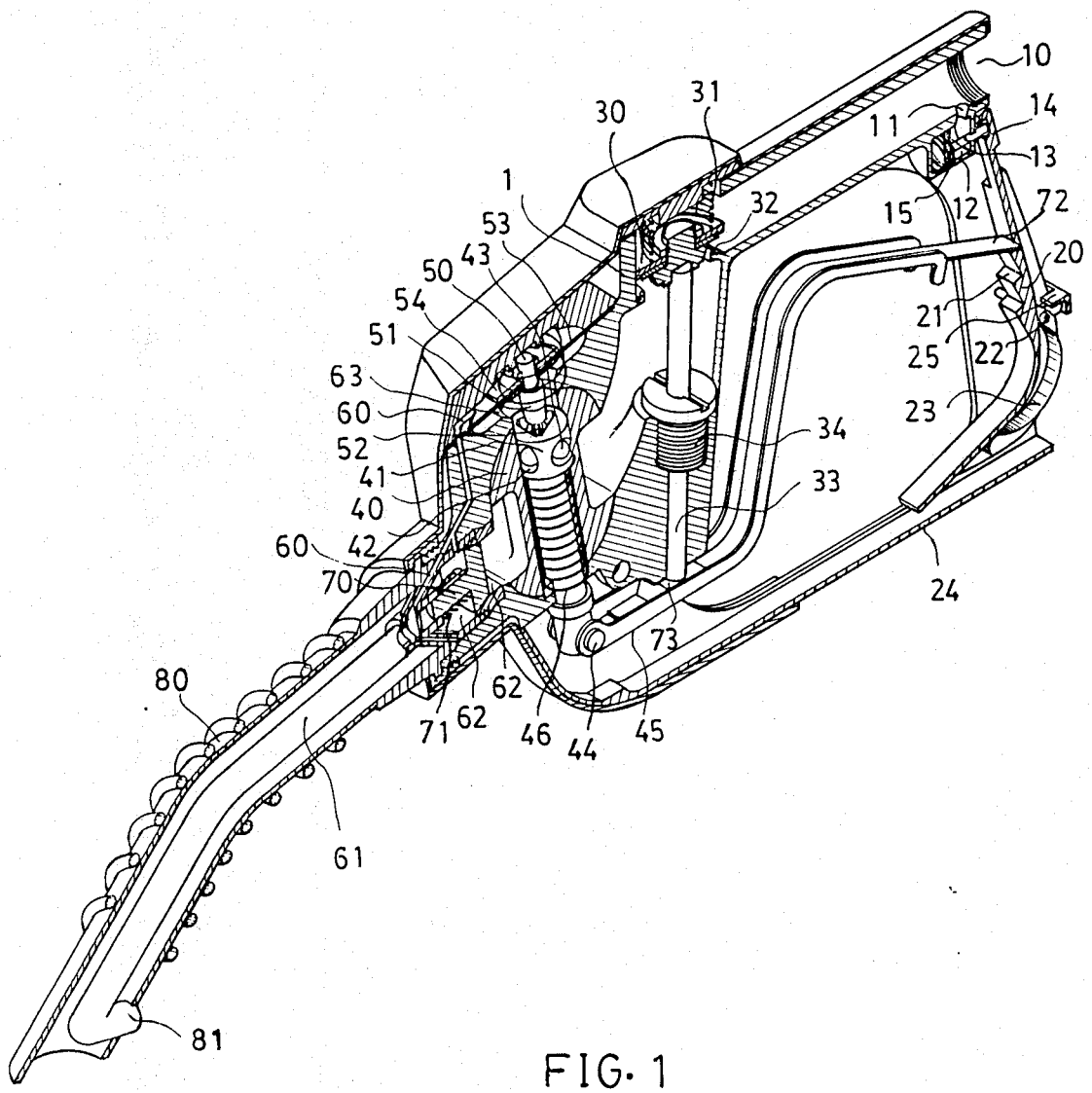
FIG. 1 is a sectional and perspective view of one embodiment of the present invention.

Referring to FIG. 1, there is shown a sectional and perspective view of one dispenser nozzle embodiment, in which the dispenser body 1 includes a cylindrical fuel pipe 10. The tail portion of the pipe 10 is furnished with a fuel manifold 11 which is connected to a sealed sensing cylinder 12 that has a sensing piston 13 and a piston stem 14. The one end of the piston 13 is biased by a compressing spring 15.

The click handle member 20 is an "L"-shaped member, in its inner bent side are furnished three one-way click teeth 21, and at its central portion is provided a pivot or fulcrum 22. Further, on the outer surface of the bent portion of the click handle member 20, there is provided a leaf-type handle spring 23, of which one end is bent around the fulcrum member 22 and contacted against a spring retainer 25. The retainer 25 has a small plate extending over the fulcrum member 22.

The valve 30 is a plate valve, which includes a spring 31, a sealing flange 32, and a valve 33. In the central portion of valve stem 33, there is mounted a flat head screw 34 which in also screwed into the dispenser body 1. The flat head screw 34 is provided with a rubber pad or seal (not shown in detail) to prevent fuel from leaking out at the bottom end of the valve stem 33.

In the inner central portion of the dispenser body 1, there is mounted a hollow cylinder 40, the two ends of which are respectively formed as hemispherically shaped portions. The hollow cylinder 40 is equipped with a movable plunger 41 of which the head portion has a greater diameter than the lower portion thereof, which lower portion forms a slender rod with a correspondingly lesser diameter. On the head portion of the plunger 41, there are furnished three sockets 42 which are arranged at a common plane and equidistant with respect to one another. In each of the three sockets 42, there is mounted corresponding steel ball 43. The lower end of the movable plunger 41 is connected with the handle 45 by means of a pin 44. The outer surface of the movable plunger 41 is surrounded by a coil spring 46. On the top of the movable plunger 41, there is mounted a diaphragm mounting head 50, and a ball-positioning taper 51 is mounted underneath the diaphragm mounting head 50, and a ball-positioning rod 52 is mounted underneath the taper 51. Further on the ball-positioning taper 51, there is mounted a diaphragm 53, which is tightly held between two recessed members forming a round cavity which, in turn, is divided into two air-tight chambers 54 by the diaphragm 53. The upper chamber 54 communicates with a small air tube 60, which is further divided into two branches, one of which is connected to a bigger longitudinal air tube or conduit 61, while the other tube branch is connected with a fuel passage 62. At the bottom of the lower air-tight chamber 54, there is furnished a steel ball-positioning collar 63.

In the fuel passage 62, there is mounted a disc-shaped valve 70, of which the rear stem is surrounded by a spring 71, while the front end is formed into a cone-shaped piston, which is fitted in a conic portion in the dispenser body 1 so as to form a valve means.

In operation, the fuel will flow with a given pressure through the fuel pipe 10, and also flow through the manifold 11 to enter into the sensing cylinder 12. Then the sensing piston 13 and the compressing spring 15 inside the cylinder 12 will be pushed backwards with the piston stem 14 being correspondingly fixed at the respective position to which it has been pushed. Then, one can pull the handle 45 with the index and middle fingers, and hold the click handle member 20 with the ring and little fingers so as to place the stop plate 72 of the tail portion of the handle 45 against the one-way click tooth member 21. Simultaneously, the movable plunger 41 will be pulled downwards, through a very small distance, by the handle 45 the steel balls 43 will be held in the steel ball positioning collar 63 by a ball-positioning taper 51. The valve stem 33 will be moved upwards by a projecting block 73 on the front portion of the handle 45, and it will open the valve 30 to let the fuel flow into the dispenser, body 1. Next, the fuel will flow around the hollow cylinder 40 to enter into the fuel passage 62. As a result of the attendant pressure, the valve 70 will be opened to let the fuel enter into the fuel tube 80; at that moment, the attendant's manual operation can be terminated and the fuel can flow automatically into the fuel tank (not shown), and the fuel filling operation with one hand is done.

The present invention may be incorporated into a do-it-yourself fuel filling machine in a gas station to be controlled with a computer system, and the fuel quantity to be filled may be set by a driver or the like. Upon the set fuel quantity set being filled into a fuel tank, the respective pump will stop automatically.

Since the dispenser of the present invention is always in the cut-off state, there will be no problem with leaking fuel; in other words, when the fuel enters under pressure into the fuel pipe 10, the fuel will also flow into the fuel manifold 11 and push the piston stem 14 backwards. One can then push the click handle member 20 downwards with the ring and little fingers, and also pull the handle 45 upwards so as to have the handle retained on the respective one-way click tooth member 21 of the handle member 20. Upon the selected fuel having been filled into a tank, the fuel pump at the fuel source will stop automatically, i.e., no fuel will flow into the fuel pipe 10. Consequently, the sensing piston 13 in the sensing cylinder 12 will be moved by the compressing spring 15, and the piston stem 14 will extend outwards until pushing against the handle member 20, which will be pushed backwards in consideration of the resultant force of the handle spring 23, the piston stem 14, and the compressing spring 15. Once the handle member 20 is pushed backwards, the handle 45 will be released, and the valve 30 will be closed by the released spring 31 as a result of the handle 45 being returned to the position in which fuel is not dispersed.

Figure 2:
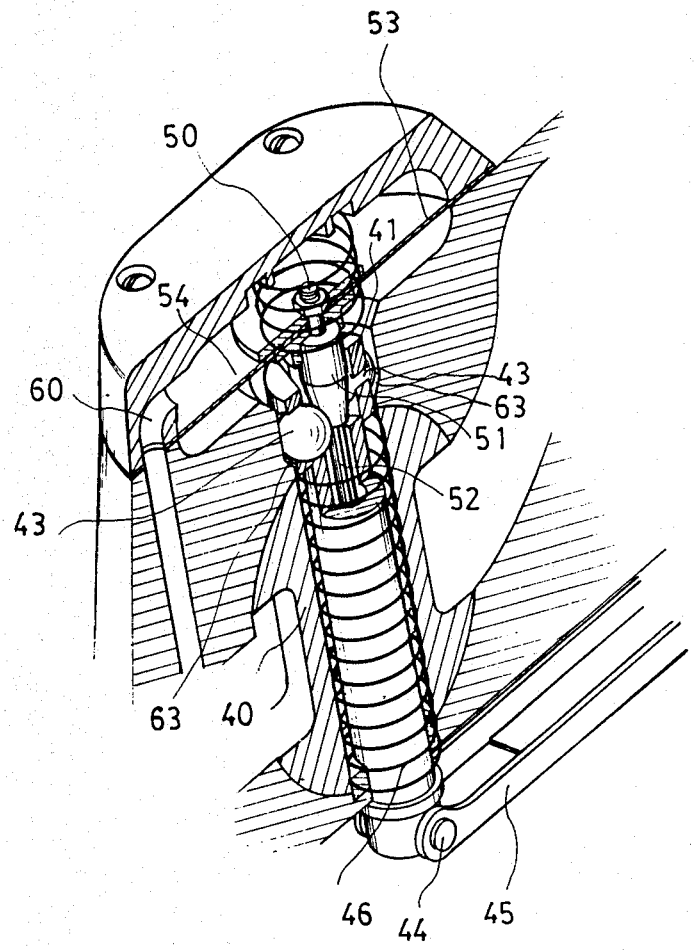
FIG. 2 is an enlarged view of the automatic shut-off device of the present invention.

Moreover, the present invention may be used to sense the fuel level in a tank being filled. Referring to FIG. 2, there is shown an enlarged view of the automatic shut-off mechanism of the present invention, in which the top portion of the fuel passage 62 (FIG. 1) is furnished with an air tube 60 which serves to communicate the upper air-tight chamber 54 and the longitudinal air tube 61 respectively. According to Venturi tube principles, fuel having a high flow velocity will have a lower pressure. When fuel is flowing through the fuel passage 62, air will be drawn, through the air tube 60, into the fuel passage 62; at that moment, the air tube 60 is communicating with the atmosphere through the longitudinal air tube 61, and a given volume of air is drawn, from the atmosphere, into the fuel passage 62. When the fuel level reaches and then closes the outlet 81 of the bigger longitudinal air tube 61, the fuel passage 62 is continuing to aspirate air. Because the outlet 81 of the bigger longitudinal air tube 61 has been closed, it can only withdraw air from the upper air-tight chamber 54. Because the air-tight chamber 54 is divided into two portions (upper and lower portions) by a diaphragm 53, the air-drawing action of the fuel passage 62 will cause the diaphragm 53 to move upwards, and thus pull the ball-positioning taper 51 upwards. Consequently, the three click steel balls 43 and the movable plunger 41 will move downwards, as well as the handle 45. The stop plate 72 will be released from the one-way click tooth member 21 and, subsequently, the valve stem 33 will be moved to restore the closed state of valve 30 and to shut-off the flow of fuel.

Figure 3:
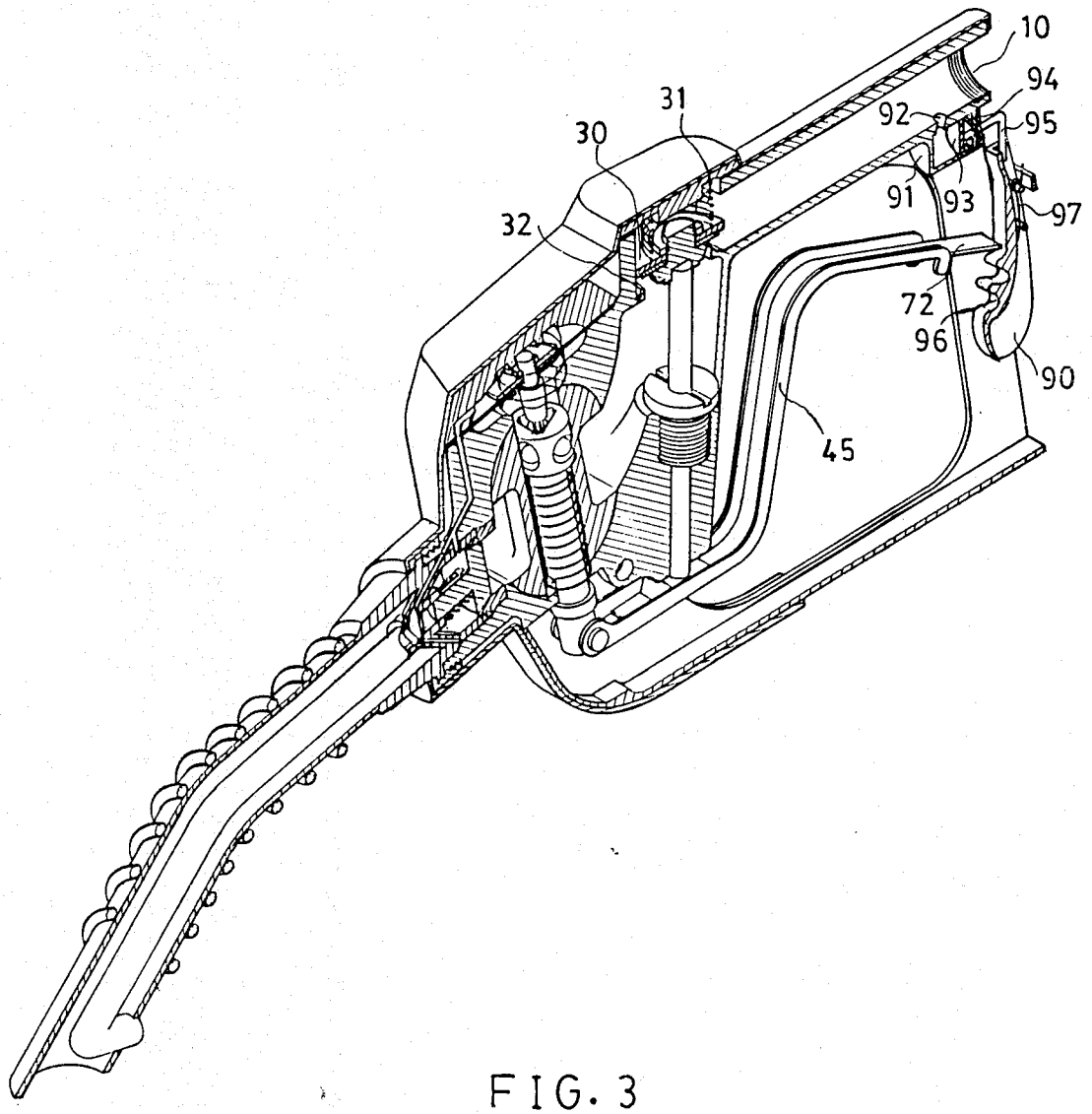
FIG. 3 is a sectional and perspective view of a second embodiment of the present invention.

FIG. 3 illustrates a perspective sectional view of a second embodiment of the present invention; the difference between the first and the second embodiments being the configuration of the handle member and the sensing cylinder. In the second embodiment, a fuel manifold 92 and a sensing cylinder 91 are connected to communicate with each other, but the sensing piston 93 and the spring 94 are differently assembled in comparison with that of the first embodiment. In the second embodiment, the piston stem 95 is formed as an "L" shape element, of which the downwardly bent segment can contact the top end of a crescent moon-shaped handle member 90.

Upon filling fuel into a tank, the stop plate 72 of the handle 45 is clicked into the one-way click tooth member 96; simultaneously, the fuel will flow, through the manifold 92, into the sensing cylinder 91 to push the sensing piston 93 and the spring 94 so as to have the "L" shaped piston stem 95 disengaged from the top of the handle member 90. When a given quantity of fuel has been filled into a tank, the spring 94 will push the sensing piston 93 to compress the fuel in the sensing cylinder 91 back into the fuel pipe 10; then, the "L"-shaped piston stem 95 will engage the top end of the handle member 90; further, by means of the pushing force of the piston stem 95 and the force of handle spring 97, the stop plate 72 will easily be released from the click tooth 96 of the handle member 90 and this releasing action of the handle 45 will cause the spring 31 to shut off the valve 30.

A computer-controlled automatic gas station will be used by the driver himself, and the fuel dispenser must be a safe and reliable dispenser. Therefore, the present invention is developed to meet the aforesaid requirement so as to prevent a person who is not quite familar with the operation of the conventional dispenser to make a hazardous mistake. Thus, the invention serves to preclude that, after filling up one fuel tank, the handle of the dispenser is still retained on the handle member to leave the valve opened, and then being put back on the dispensing machine. If the valve remains open, the next driver coming to select a fuel quantity would have fuel gush out of the dispenser immediately. In contrast, the dispenser suggested in the present invention can shut off the valve immediately after refuelling so as to prevent hazards at the dispenser.

I claim:

1. An automatic shut-off dispensing nozzle, especially for dispensing liquid fuel, said nozzle comprising:

(a) a hollow walled handle body, said body defining a chamber, and said body having an inlet, an outlet, and passage means connecting said inlet to said outlet; said passage means being adapted to create a venturi effect when liquid flows through said passage means from said inlet to said outlet in response to activation of a pressurized source of fuel communicating with said inlet; and said passage means providing communication with the atmosphere and said chamber;

(b) a first valve means, said first valve means being arranged at the outlet of said handle body and adapted to allow fuel flow;

(c) a second valve means in said passage means for controlling liquid fuel flow from said inlet to said outlet of said body;

(d) movable control handle means for moving said second valve means to an open position;

(e) means for retaining said control handle means when said second valve means is in an open position, and said retaining means being adapted to release said control handle means when fuel flow is terminated;

(f) at least one diaphragm operatively arranged in said chamber of said hollow walled handle body;

(g) actuating means to release said control handle means resulting in said second valve means being moved to its closed position; said at least one diaphragm being connected to said actuating means in such a way to render said actuating means effective upon movement of said at least one diaphragm in response to a partial vacuum being created in said chamber when the level of the liquid in a respective tank being filled reaches a predetermined level;

(h) a handle guard secured at said handle body;

(i) means for controlling the position of said control handle means when fuel flow from said inlet to said outlet of said body is terminated, a sensing cylinder which is mounted under said passage means at the inlet of said handle body but above said handle guard; and said cylinder including a compression spring;

a sensing piston with an L-shaped piston stem;

wherein upon the flow of liquid being terminated, the returning force of said compression spring will move said piston stem and said retaining means until said control handle means is separated from said retaining means to automatically terminate fuel flow.

2. The nozzle according to claim 1 wherein said actuating means is mounted in a hollow cylinder the two ends of which are formed with hemispherical portions.

3. The nozzle according to claim 1 and further including an outlet spout secured at said handle body, wherein said passage means includes a longitudinal air duct concentrically disposed in said outlet spout of said nozzle and channel means connecting said longitudinal air duct with said chamber for housing said at least one diaphragm.

4. The nozzle according to claim 1 wherein said retaining means has a first, inner bent side which is equipped with at least one tooth adapted to be operatively engaged by said control handle means; said retaining means having at the central portion thereof a fulcrum portion; and further comprising means mounted at said fulcrum portion for biasing said retaining means.

* * * * *